US005507338A

United States Patent [19]

Schornhorst et al.

[11] Patent Number: 5,507,338

[45] Date of Patent: Apr. 16, 1996

[54] TAB FOR AN AUTOMOTIVE HEAT EXCHANGER

[75] Inventors: Carl E. Schornhorst, Canton, Mich.; Kevin B. Wise; Gerald J. Selm, both of Connersville, Ind.

[73] Assignee: Ford Motor Company, Dearborn, Mich.

[21] Appl. No.: 521,507

[22] Filed: Aug. 30, 1995

[51] Int. Cl.[6] ..... F28D 1/03

[52] U.S. Cl. ..... 165/76; 72/379.2; 29/890.039; 165/153; 165/DIG. 464

[58] Field of Search ..... 29/890.03, 890.039; 72/379.2; 165/76, 152

[56] References Cited

U.S. PATENT DOCUMENTS

| | | | |
|---|---|---|---|
| 1,941,892 | 1/1934 | Greve | 72/379.2 X |
| 2,490,976 | 12/1949 | Mayne et al. | 72/379.2 X |
| 2,560,786 | 7/1951 | Wright et al. | 72/379.2 X |
| 2,728,982 | 1/1956 | Merrill | 29/533 |
| 3,258,832 | 7/1966 | Gerstung . | |
| 3,292,690 | 9/1967 | Gerstung . | |
| 3,341,925 | 9/1967 | Gerstung . | |
| 3,425,113 | 2/1969 | Ward, Jr. . | |
| 3,762,031 | 10/1973 | Jonason et al. . | |
| 4,434,643 | 3/1984 | Almqvist et al. . | |
| 4,562,630 | 1/1986 | Larsson . | |
| 4,628,661 | 12/1986 | St. Louis | 52/658 |
| 4,679,410 | 7/1987 | Drayer . | |

FOREIGN PATENT DOCUMENTS

| | | |
|---|---|---|
| 61-217697 | 9/1986 | Japan . |
| 62-203632 | 8/1987 | Japan . |
| 63-278621 | 11/1988 | Japan . |

*Primary Examiner*—Allen J. Flanigan
*Attorney, Agent, or Firm*—Raymond L. Coppiellie; Roger L. May

[57] ABSTRACT

A tab for joining together a plurality of adjacent, contiguous plate menders of a plate tube heat exchanger is disclosed. The tab comprises a generally planar web interconnecting adjacent plates. The web includes a first edge having a plurality of recesses disposed at predetermined locations therealong and a second edge having a plurality of recesses disposed opposite the plurality of recesses along the first edge. The plurality of recesses define first and second bend zones which provide proper plate-to-plate contact when forming the plate tubes as well as proper fin height spacing between adjacent pairs of plate tubes.

10 Claims, 3 Drawing Sheets

TAB FOR AN AUTOMOTIVE HEAT EXCHANGER

BACKGROUND OF THE INVENTION

1. Field of the Invention

The present invention relates generally to a heat exchanger for an automotive vehicle. More particularly, the present invention relates to a tab for joining together a plurality of contiguous plates which are folded together to manufacture a plate-tube type heat exchanger.

2. Disclosure Information

Plate-tube type heat exchangers are well known in the art. In these types of heat exchangers, a plurality of elongated plates are joined together, such as through a lamination process to define a plurality of passageways for the movement of a fluid therethrough. Each of the passageways is formed by the inwardly facing surfaces of a pair of joined plates. The interior surfaces of the joined plates generally define a central fluid conducting section. The passageways are interconnected so that a fluid may flow through the plurality of joined plates forming the heat exchanger. As is also known in the art, conductive fin strips are located between outwardly facing surfaces of the pairs of joined plates. Heat exchangers of this type have particular utility as evaporators for air conditioning systems of motor vehicles.

Typically, plate-tube heat exchangers are manufactured by stacking a plurality of individual plates together to form a plate tube member and interleaving fin members between each tube member. Endsheets are then placed on opposite ends of the heat exchanger to form a heat exchanger core and the core is brazed in a furnace to complete the manufacturing process. Assembling the heat exchanger core in this manner is a labor intensive process requiring personnel to physically place individual plates in abutting face-to-face relationship to form the plate tube member.

One proposed method which may increase the productivity in fabricating plate-tube heat exchangers is shown in U.S. Pat. Nos. 3,258,832 and 3,344,925. These patents disclose a method of making a heat exchanger wherein a plurality of individual plates are stamped from a single sheet of material and interlinked together by tab members. The tab member is a straight piece of metal material which connects the plates and provides a location for bending to occur. After being formed, the plates are folded in a zig-zag formation to form a heat exchanger core. The tab member, however, bends at an undetermined location and cannot provide the most beneficial spacing for a fin member to be included between adjacent pairs of plate tubes and at the same time provide proper plate-to-plate contact.

It would be advantageous to provide a tab which can bend at different locations to provide for proper plate-to-plate contact when forming the plate tubes as well as to provide proper fin height spacing between adjacent pairs of plate tubes.

SUMMARY OF THE INVENTION

The present invention overcomes the above problems with the prior art by providing a tab for joining together adjacent plates in a series of contiguous plates of a heat exchanger, the plates being generally planar and having a longitudinal axis and a transverse axis. The tab comprises a generally planar web which interconnects adjacent plates. The web includes a first edge having a plurality of recesses disposed at predetermined locations therealong and a second edge having a plurality of recesses disposed opposite the plurality of recesses along the first edge. The plurality of recesses define first and second bend zones which provide proper plate-to-plate contact when forming the plate tubes as well as proper fin height spacing between adjacent pairs of plate tubes.

It is an advantage of the present invention to provide a tab which allows for two bending zones to accommodate fin height between plate tubes as well as provide good plate-to-plate contact in forming the tubes. These and other objects, features and advantages of the present invention will become apparent from the drawings, detailed description and claims which follow.

DETAILED DESCRIPTION OF THE PREFERRED EMBODIMENTS

Figure 1:
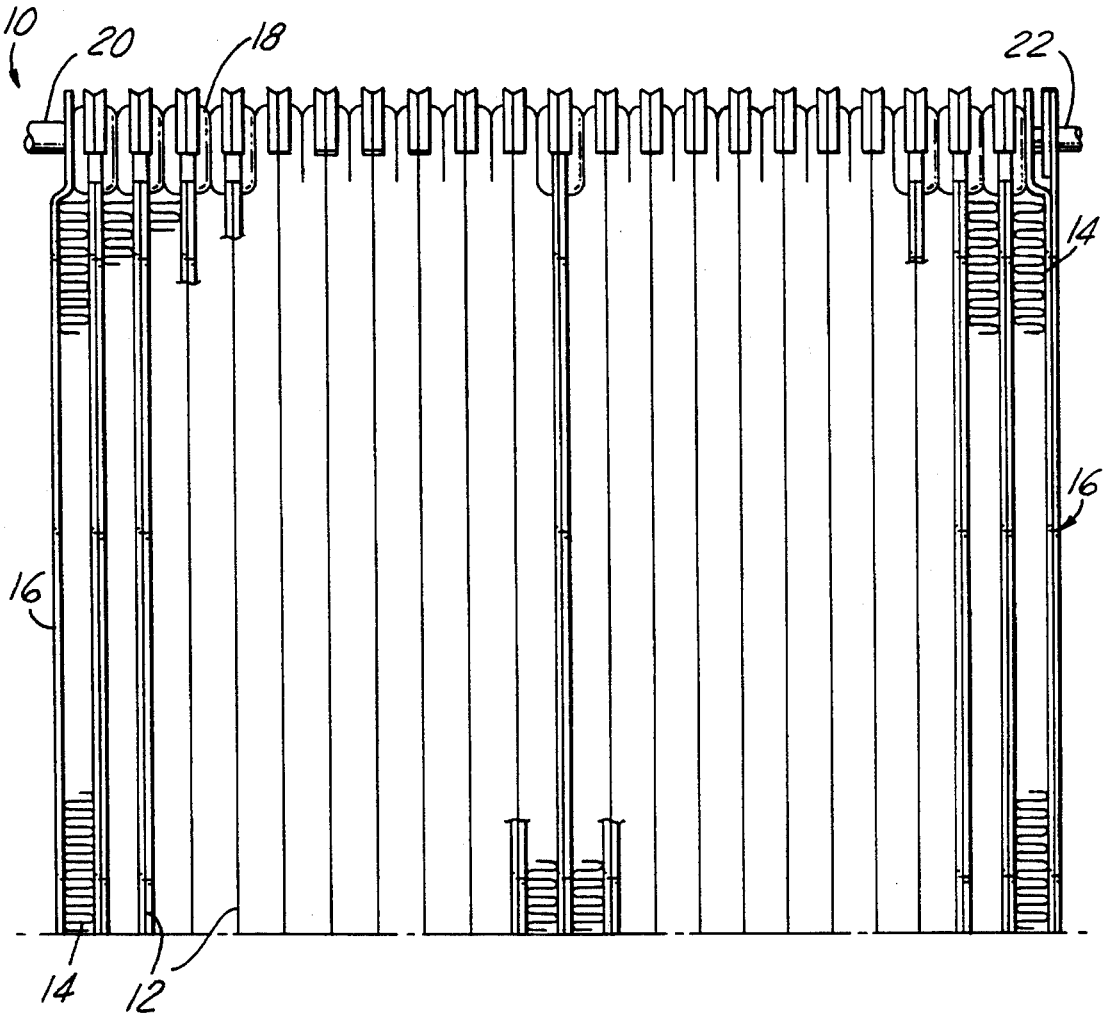
FIG. 1 is a perspective view of a heat exchanger structured in accord with the principles of the present invention.

Referring now to the drawings, FIG. 1 shows a plate-tube heat exchanger, generally designated by the numeral 10, in the form of an evaporator particularly adapted for use in an automobile air conditioning system. The heat exchanger 10 comprises a stack of formed, elongated plates 12, pairs of which are joined together in face-to-face relationship so that adjacent pairs provide alternate passageways for the flow of refrigerant therebetween as will be described further below. The plates may be joined in any of a variety of known processes, such as through brazing or a lamination process. Heat transfer fins 14 are positioned between joined pairs of plates 12 to provide increased heat transfer area as is well known in the art. The joined plate pairs and fin assemblies are contained within endsheets 16.

The heat exchanger 10 includes an inlet port 20 and an outlet port 22 formed within a header 18 at either one or both ends of the heat exchanger 10. The header is in direct communication with the passageways between the joined pairs of plates 12 as will become apparent from the following description. The plates 12 have aligned apertures at the ends thereof providing communication between inlet and outlet ports 20, 22, respectively, of header 18. However, as is well known in the art, each of the plates can include apertures at either one or both ends thereof and the inlet and outlet ports 20, 22 can be located at opposite ends of the heat exchanger as is well known in the art. In the heat exchanger FIG. 1, refrigerant is directed into the inlet port 20, passed through the pair plurality of joined plates 12 in a known manner. The refrigerant then exits through outlet ports 22 to complete the cooling cycle.

Figure 2:
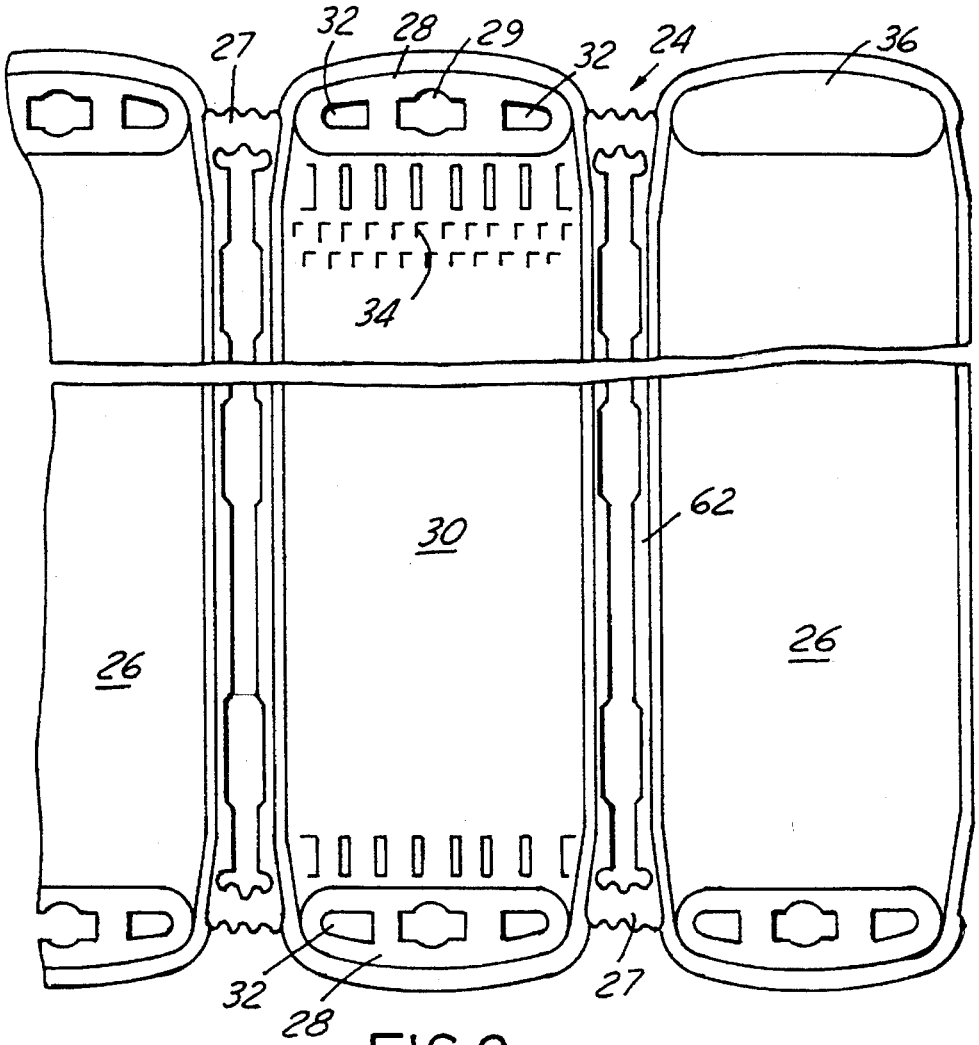
FIG. 2 is a plan view of a continuous sheet of plate members manufactured according to a method of the present invention.

As shown in FIG. 2, the plate members 26 are formed from a single sheet of material 24 and are interconnected by a deformable tab 27 which will be described in greater detail below. The material 24 can be an aluminum material coated with an aluminum brazing alloy as is known in the art. A sheet of material 24 can either be of a predetermined length with a predetermined number of plate members 26 therein or may be formed as a continuous strip of material which is cut at a predetermined number of plates to form a heat exchanger of predetermined size. The plate members 26 are stamped using pneumatic and/or hydraulic activated details in a die controlled by a PLC\PLS or other computerized means known in the die pressing art.

Each of the plate members 26 includes a pair of end portions 28 and an intermediate portion 30 therebetween. A plurality of apertures 32 can be formed in each of the end portions 28 or alternatively, a single aperture can be formed therein. The apertures are aligned when the heat exchanger is assembled to provide for a fluid conduit for the heat exchanger fluid to pass therethrough. As shown in FIG. 2, the central aperture includes a radius portion 29. The radius portion provides for alignment of the inlet tube during its insertion into the core during the assembly process. Each of the intermediate portions 30 of the plate members 26 includes a plurality of beads 34 which, as is well known in the art, provide a circuitous path for the fluid to pass through the plate tube 12 to increase the turbulence of the fluid and provide for better heat transfer characteristics.

As further shown in FIG. 2, selected end portions 28 of plate members 26 include end portions in which the apertures 32 are not included. These blanked ends 36 provide a baffle means in the heat exchanger by not allowing the fluid to pass thereby, forcing the fluid to assume a new flow direction within the heat exchanger. This provides an advantage over known heat exchangers without the baffle means which may not work as effectively as the present invention. At the time the plate members 26 are formed, it is determined which of the selected end portions of the plate members are blanked (at 36) to form the baffle means of the heat exchanger. The manifold plates are then also formed.

Figure 4:
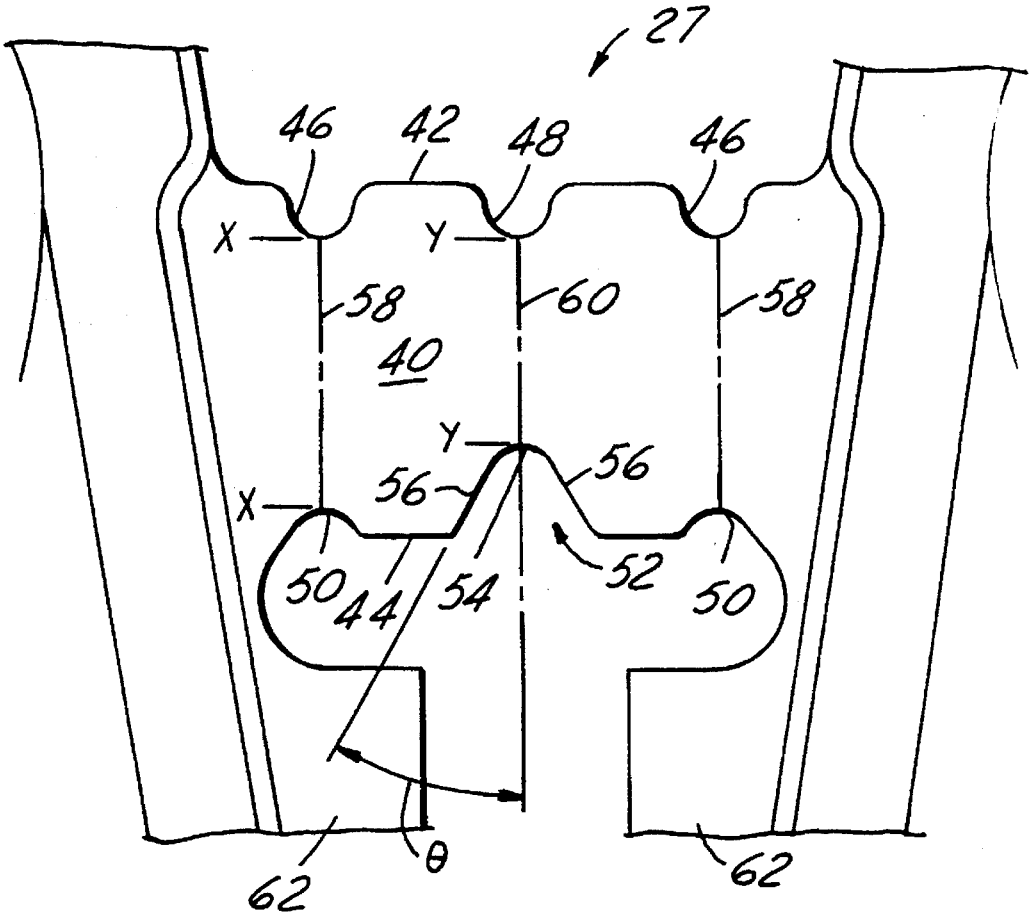
FIG. 4 is an enlarged view of the tab connecting adjacent plates in accordance with the present invention.

As shown in FIG. 4, each of the deformable tabs 27 interconnecting adjacent plates includes a web 40 of deformable material. The web 40 is disposed generally parallel to the transverse axis of the plates and includes a first edge 42 and a second edge 44. The first edge 42 includes a first pair of distal recesses 46 and a first central, medial recess 48. In the preferred embodiment of the tab, these recesses 46, 48 are generally arcuate, having a radius of curvature of approximately 0.0300 inches. The present invention contemplates that other shaped recesses may work equally as well, such as triangled-shaped recess, or arcuate recesses having different sized radii of curvature.

Similarly, the second edge 44 of web 40 includes a second pair of distal recesses 50 and a second, generally centrally disposed medial recess 52. The second pair of distal recesses 50 are also generally arcuate in shape and are generally disposed opposite the first pair of distal recesses 46. In the preferred embodiment of the tab, these recesses 50 are generally arcuate, having a radius of curvature of approximately 0.0300 inches. The present invention contemplates that other shaped recesses may work equally as well, such as triangled-shaped recess, or arcuate recesses having different sized radii of curvature.

The second medial recess 52 includes a generally arcuate portion 54 and a pair of generally straight leg portions 56 connected to the arcuate portion 54. These leg portions are disposed at a predetermined angle q relative to the longitudinal axis of the plate. In the preferred embodiment of the present invention, q is between 20 and 40 degrees, and preferably 30 degrees.

As seen in FIG. 4, the distance, x—x, between the first and second pairs of distal recesses 46, 50, respectively is greater then the distance, y—y, between the first and second medial recesses 48, 52, respectively. These distances, x—x and y—y define a pair of first bend zones 58 and a second bend zone 60. The first bend zones 58 provide a location at which the web 40 bends during the folding of the plates in forming the core to allow for fin insertion between adjacent plate tubes. The distance between the two first bend zones 58 is approximately equal to the fin height. The second bend zone 60 allows for much more narrow bending to accomplish good plate-to-plate contact during the forming of the heat exchanger core by the zig-zag folding of the contiguous plates. In this manner, the tab 27 allows for fin insertion as well as plate-to-plate contact in a very efficient manner.

Also, the thickness of the material of the web 40 varies between the first and second bend zones, 58, 60, respectively. For example only, the thickness of the web material at the pair of first bend zones 58 is approximately 0.240 inches while the thickness of the web material at the second bend zone 60 is approximately 0.180 inches. By varying the thickness of the web material as such, greater accuracy in bending can occur.

Typically, each plate will be connected to an adjacent plate by a pair of tabs 27. The pair of tabs are separated by a longitudinal member 62 formed at each edge of each plate. However, the present invention contemplates that a single tab 27 may be used as well.

Figure 3:
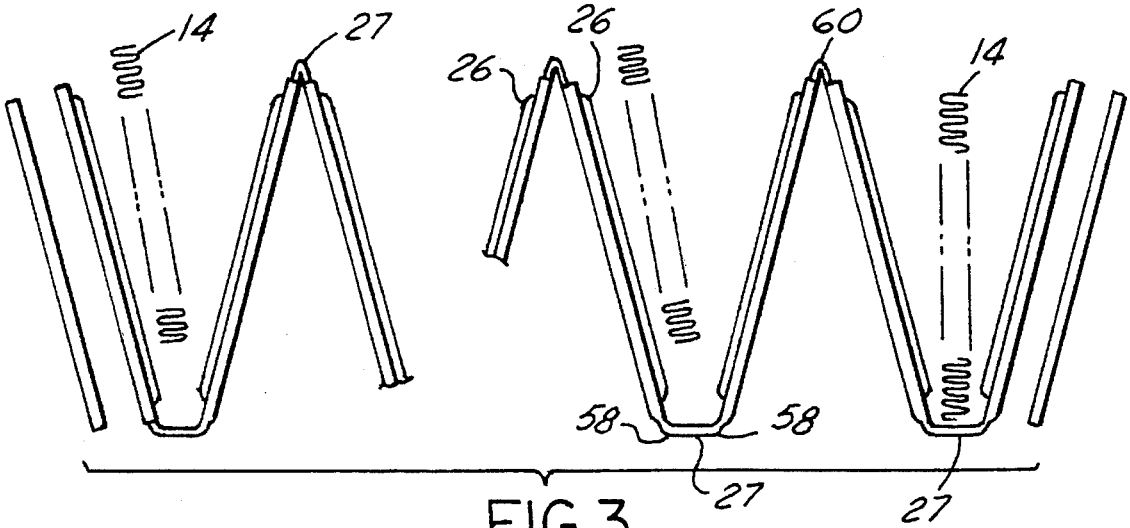
FIG. 3 is an end view of the sheet of FIG. 2 being folded into plate tube members.

To manufacture an evaporator according to a method of the present invention, the plate members 26 and tabs 27 are stamped from the sheet of material 24 and certain selected end portions 36 are left blank to form a baffle and manifold plates for the heat exchanger. The plate members 26 are then bent at the bend zones 58, 60 in the tabs 27 into folds such as shown in FIG. 3 so that adjacent plate members 26 are in abutting, face-to-face relationship to form a plate tube member 12 and that sufficient space remains between adjacent plate tubes remains for fin insertion. After the plate members 26 have been folded a predetermined amount, the fin members 14 are inserted between outwardly facing surfaces of the pairs of the plate members 26, either manually or automatically. After the fin members have been inserted, endsheets 16 are added at opposite ends of the plate tube\fin assembly to complete the heat exchanger core and the core is compressed under a predetermined load. The core is then placed into a brazing furnace and passed through a vacuum brazing operation in which the metal brazes together in order to form the completed article.

When completed, the heat exchanger, such as evaporator 10, will include a baffle formed in a predetermined number of the plate tube members for defining a predetermined fluid pathway for the fluid heat exchanger fluid to follow. As such, the fluid flows through the heat exchanger in a much more efficient manner allowing for greater heat transfer characteristics of the evaporator. The evaporator can be assembled with less labor than in typical prior art manufacturing processes and can be completed in a much more productive time period.

Various modifications and alterations of the present invention will, no doubt, occur to those skilled in the art to which this invention pertains. For example, the present invention has been described with reference to tab members joining plates along longitudinal axes. The present invention also contemplates that the plates may be joined along the transverse axis as well, using the tab members of the present invention. These and all other variations which rely upon the teachings by which this disclosure has advanced the art are properly considered within the scope of this invention as defined by the appended claims.

What is claimed is:

1. A tab for joining together adjacent plates in a series of contiguous plates of a heat exchanger, the plates being generally planar and having a longitudinal axis and a transverse axis, said tab comprising:

a generally planar web interconnecting adjacent plates, said web including:

a first edge including a plurality of recesses disposed at predetermined locations therealong; and a second edge including a plurality of recesses disposed opposite said plurality of recesses along said first edge.

2. A tab according to claim 1, wherein said plurality of recesses along said first edge of said web are generally arcuate.

3. A tab according to claim 1, wherein said first edge of said web includes a first pair of generally arcuate, distal recesses and a first medial, generally arcuate recess interposed between each of said first pair of distal recesses.

4. A tab according to claim 1, wherein said second edge of said web includes a second pair of generally arcuate, distal recesses disposed opposite said first pair of distal recesses of said first edge by a predetermined distance and a second medial recess interposed between each of said second pair of distal recesses, said second medial recess being disposed opposite said first medial recess by a predetermined distance.

5. A tab according to claim 4, wherein the predetermined distance between the first and second pairs of distal recesses is greater than the distance between said first and second medial recesses.

6. A tab according to claim 4, wherein the second medial recess includes a generally arcuate portion and a pair of generally straight leg portions connected thereto, said leg portions being disposed at an angle of between 20 to 40 degrees relative to the longitudinal axis of the plate.

7. A tab according to claim 1, further including a pair of webs disposed a predetermined distance apart and being connected together by a generally longitudinal member.

8. A tab according to claim 4, further including a first bend zone formed between the opposite pairs of distal recesses and a second bend zone formed between opposite medial recesses.

9. A tab for joining together adjacent plates in a series of contiguous plates of a heat exchanger, the plates being generally planar and having a longitudinal axis and a transverse axis, said tab comprising:

a generally planar web disposed generally parallel to the transverse axis of the plates and interconnecting adjacent plates, said web including:

a first edge including a pair of generally arcuate, distal recesses and a generally arcuate medial recess disposed at predetermined locations therealong; and a second edge including a pair of generally arcuate, distal recesses disposed opposite said distal recesses in said first edge and a generally arcuate medial recess disposed opposite said medial recess in said first edge;

a first bend zone defined between opposite pairs of distal recesses in said first and second edges; and a second bend zone defined between opposite medial recesses of said first and second edges, wherein said first bend zone is of greater length than said second bend zone.

10. A tab according to claim 9, wherein the second medial recess includes a generally arcuate portion and a pair of generally straight leg portions connected thereto, said leg portions being disposed at an angle of 30 degrees relative to the longitudinal axis of the plate.

* * * * *